United States Patent [19]

Allison

[11] 4,004,534

[45] Jan. 25, 1977

[54] BOAT HULL

[76] Inventor: Darris E. Allison, Rtc. 4, Box 1, Louisville, Tenn. 37777

[22] Filed: Nov. 28, 1975

[21] Appl. No.: 636,029

[52] U.S. Cl. ..... 114/274; 114/56; 114/61

[51] Int. Cl.[2] ..... B63B 1/20

[58] Field of Search ..... 114/56, 57, 61, 66.5 R, 114/66.5 F, 66.5 S; 115/39; D12/62

[56] References Cited

UNITED STATES PATENTS

| | | | |
|---|---|---|---|
| 2,815,730 | 12/1957 | Horsdal | 114/56 |
| 2,989,939 | 6/1961 | Tatter | 114/56 |
| 2,995,104 | 8/1961 | Mills | 114/66.5 S |
| 3,148,652 | 9/1964 | Canazzi | 114/66.5 S |
| 3,937,164 | 2/1976 | Austin | 114/66.5 R |

*Primary Examiner*—Trygve M. Blix
*Assistant Examiner*—Stuart M. Goldstein
*Attorney, Agent, or Firm*—Fitch, Even, Tabin & Luedeka

[57] ABSTRACT

A boat hull comprising a generally elongated body portion and port and starboard elongated sponsons disposed along the opposite side margins of the body portion and defining elongated running surfaces, the sponsons terminating at respective locations forward of the transom means but aft of the transverse midplane of the hull. A central sponson depends from the body portion centrally of the port and starboard sponsons and defines a further elongated running surface that extends from a location forwardly of the aft terminal ends of the port and starboard sponsons to the approximate location of the transom means. The sponsons, in combination with the body of the hull, define tunnels on opposite sides of the central sponson. These tunnels are open at their respective forward and aft ends for the flow of fluid therealong.

5 Claims, 10 Drawing Figures

BOAT HULL

This invention relates to boat hulls.

Insofar as relevant to the present invention, the prior art includes boat hulls designated as tunnel boats and V-bottom boats. The hull of a tunnel boat comprises a substantially flat body portion that includes a pair of elongated sponson members protruding from the hull and defining, with the flat body member, a single elongated open ended tunnel that extends between the bow and aft ends of the boat. The crosssectional area of this tunnel decreases from the bow toward the aft end of the boat. When the boat is at rest in the water or moving slowly, a substantial part of the body portion and usually the major portion of the sponsons rest or ride beneath the surface of the water. As the boat speed increases, for example at about 20 miles per hour and up, air flowing into the bow end of the tunnel is compressed along the length of the tunnel to impart lift to the boat. At "cruising" speeds, the air flows completely through the tunnel, being compressed along its path, and provides the principal source of lift for the boat as it rides over the surface of the water. Under such conditions and at such speeds, only the aft end portions of the sponsons are in contact with the water. These boats have a serious tendency to flip rearwardly due to wind forces acting on the bow portion of the boat hull. They also are slow to accelerate due to the time required to develop sufficient compression of the air in the tunnel to develop the necessary lift to reduce the frictional drag of the boat as it moves over the surface of the water. Further, tunnel boats are relatively slow due to the substantial area of the sponsons that remain in the water while the boat is underway.

The so-called V-bottom boat comprises a hull that includes a generally triangular cross-sectional bottom geometry. The V-bottom hull generally transists from a pointed bow to a generally pentagonal cross-section at the aft end of the boat. The geometry of the boat hull includes a "keel line" extending from the bow end of the boat rearwardly to a location adjacent the aft end of the hull. Depending upon the particular hull design, this "keel line" may terminate forwardly of the boat transom, but in some boats it extends to the transom. When V-bottom boats are at rest in the water, a substantial portion of the hull is beneath the surface of the water. As the boat moves forwardly through the water, the keel line "splits" the water in the well-known manner. At its cruising and higher speeds, the V-bottom boat rides on a small solid triangular portion of the aft end of the boat hull. This triangular portion lies substantially parallel to the surface of the water with one of its apeces pointing toward the bow of the boat and the other two apeces located adjacent the opposite sides of the aft end of the boat hull. The lift of the boat is provided principally by this small triangular area. These boats are slow accelerating due to the relatively large surface of the boat hull in contact with the water initially. At high speeds, they are laterally unstable due to the tendency of the boat to fall off the triangular lift portion so that the boat requires a skilled driver for high speed operation. As a further consequence of the relatively small triangular lift area, the boat is subject to poor control unless extreme care is taken to eliminate slack in the steering mechanism. Further, the trim of the motor is critical to optimum performance and such trim requirements change as the boat changes its speed.

V-bottom boats also are relatively slow due to the solidity of the triangular lift portion that remains in contact with the water when the boat is underway.

In race boats and in the increasingly popular bass fishing boats, acceleration and speed are considered desirable features. In addition, stability of the boat both when at rest in water and when underway are sought-after features. Neither tunnel boats nor V-bottom boats provide these features to the desired degree.

Accordingly, it is an object of the present invention to provide an improved boat hull. It is another object to provide a boat hull that provides enhanced acceleration, stability, and speed. It is another object to provide an improved boat hull suitable for a multiplicity of boat types. Other objects and advantages of the invention will be apparent from the following description, including the drawings in which.

In accordance with the present disclosure, there is provided a boat hull comprising a generally elongated body portion including bow means and transom means. First and second elongated sponsons are provided along each of the opposite side margins of the body portion and define elongated running surfaces, each of the sponson means terminating at its respective aft end at a location forward of the transom means but aft of the transverse midplane of the hull. A third elongated sponson means depends from the body portion at a location centrally thereof in substantial alignment with the longitudinal centerline of the body portion and defines a further elongated running surface that extends from a location forwardly of the aft terminal ends of the first and second sponson means to the approximate location of the transom means. The first and third sponson means, in combination with the body portion, define a first elongated tunnel means extending along a substantial portion of the length of the hull in general alignment with the longitudinal centerline of the hull but displaced laterally thereof. The second and third sponson means define a further tunnel means extending along a substantial portion of the length of the hull in general alignment with and on the opposite side of the longitudinal centerline of the hull, but displaced laterally thereof, as the first tunnel means. These tunnel means are open at their respective forward and aft ends for the flow of fluid therealong and preferably decrease in cross-sectional area along their lengths in a direction from the bow toward the aft end of the hull.

In operation, as the boat commences movement over a surface of water, air entering the forward ends of the tunnels is compressed along the length of the tunnels to impart lift to the boat. Additional lift is provided by the running surfaces. As the boat gains speed over the water, more lift is generated until at maximum speed, only the aft terminal ends of the first and second sponsons and the aft end of the third sponson ride in the water, thereby providing a three-point triangular support of the boat on the water. Notably, two of the points of support are located forwardly of the transom, but rearwardly of the transverse midplane of the hull, and one on each of the port and starboard sides of the hull. These points of support provide lateral support to the hull and stabilize the hull against rotation about the longitudinal centerline of the hull. The third point of support is located at the aft end of the hull adjacent the transom and provides substantial upward lift to the aft end of the boat and stabilizes the boat against rotation about its transverse centerline.

Figure 1:
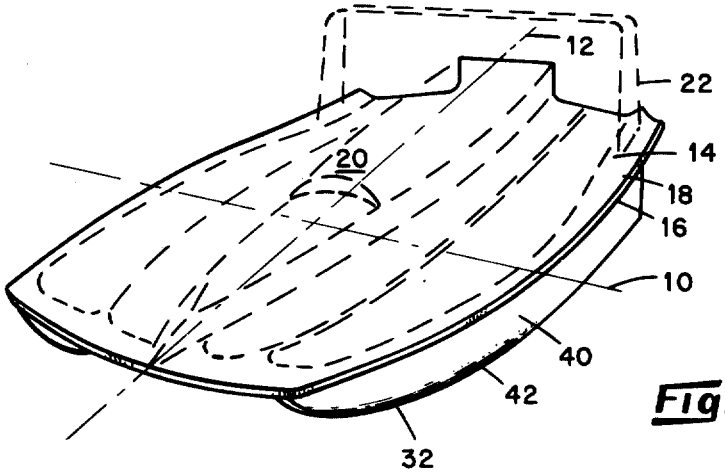
FIG. 1 is a representation of a boat including a hull embodying various features of the invention.
Figure 2:
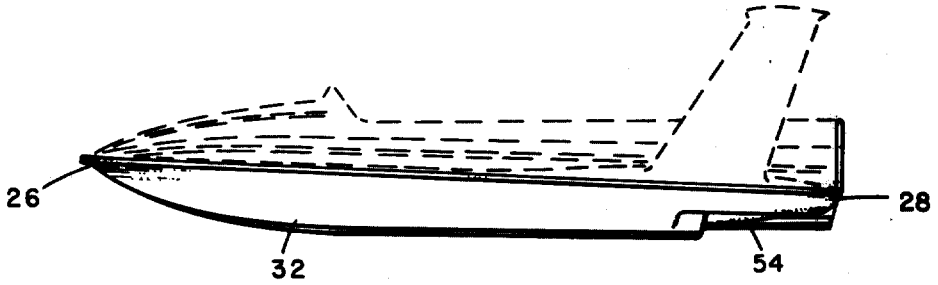
FIG. 2 is a port side elevation of the boat hull.
Figure 3:
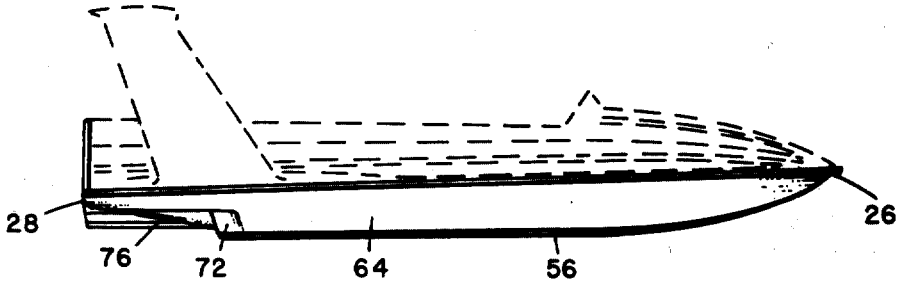
FIG. 3 is a starboard side elevation of the boat hull.

In the figures, there is shown a boat hull 10 comprising a generally elongated body portion defining a substantially hollowed out shell that is symmetrical about its longitudinal centerline 12. In FIG. 1, the hull is shown with a deck 14 mounted thereon, such deck being secured at its circumferential edge 16 to the circumferential top edge 18 of the hull. The disclosed deck includes a cockpit 20, and an air foil 22 adjacent the aft end thereof. It is to be recognized, however, that the deck shown is not critical to the invention, and that any deck of suitable design can be utilized with the disclosed boat hull.

As depicted, the hull 10 includes a bottom surface 24 adapted to ride in the water when the boat is at rest or slowly moving across the surface of a body of water. The forward end or bow 26 of the hull is tapered to reduce frictional drag as the boat moves forwardly. The rear or aft end 28 of the hull is closed by a transom 30.

Figure 8:
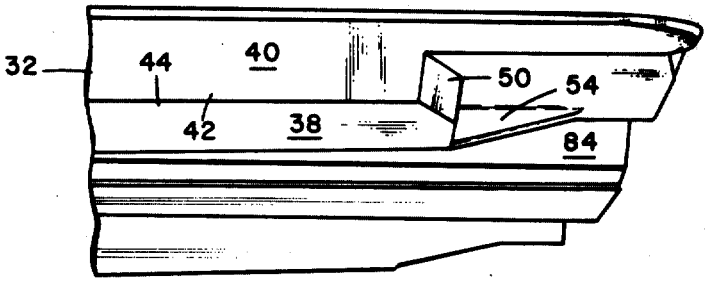
FIG. 8 is a fragmentary view taken from the port side of the aft end of the boat hull.
Figure 9:
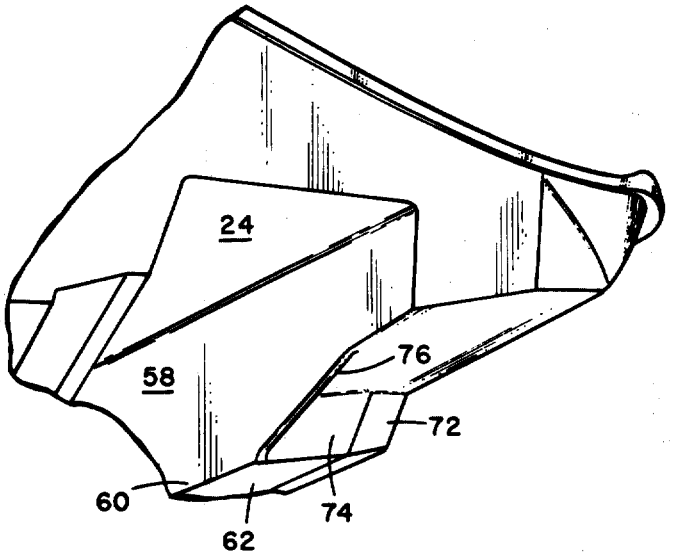
FIG. 9 is a further fragmentary view of the starboard aft end of the hull.

A first elongated sponson means 32, referred to herein as the port sponson, extends along the left or port side of the hull and depends from the bottom surface thereof. This port sponson begins at a location substantially adjacent the bow of the hull and terminates at a location forward of the aft end of the hull, but rearward of the transverse midplane of the hull. The depicted sponson is of generally U-shaped cross-section and hollow with an open top. It is joined to the bottom surface 24 of the hull at the top edge 33 of a first elongated upright inboard side panel 34 thereof so that such panel 34 depends from the bottom surface 24 of the hull. This inboard side panel 34 is joined at its lower edge 36 to a second and bottom elongated panel 38 that is oriented substantially horizontally and which defines the running surface of the port sponson. An elongated outboard panel 40 is joined at its bottom edge 42 to the outboard edge 44 of the bottom panel 38. This outboard side panel 40 of the port sponson extends upwardly to define the port side of the hull. The depicted port sponson is pointed at its forward end 46 and increases in cross-sectional area to the approximate transverse midplane of the shell. The aft end portion 48 of the port sponson is of substantially constant cross-sectional area. As noted above, the port sponson terminates at a location forwardly of the aft end 28 of the hull and is closed by first and second upright panels 50 and 52, the first 50 of which slants inwardly of the hull and rearwardly of the outboard side panel 40 of the port sponson and forms an angle of about 135° therewith to reduce eddy currents at the aft terminal end of the sponson as the boat moves through the water, hence reduce frictional drag on the boat. The second panel 52 that closes the end of the port sponson is integrally formed with the first panel 50 and is oriented generally perpendicular to the longitudinal centerline of the hull. As best seen in FIG. 8, a generally triangular gusset 54 is provided as a continuation of the inboard side panel 34 of the port sponson, such gusset tapering rearwardly from the aft end of the sponson. This gusset, being substantially a continuation of the inboard side panel 34 of the port sponson, functions to reduce the flow of water and/or air laterally of the hull at the aft end of the sponson as will be explained further hereinafter.

A second sponson means 56 is provided on the starboard side on the hull and referred to hereinafter as the starboard sponson. This starboard sponson is substantially a mirror image of the port sponson and comprises a first elongated upright inboard side panel 58 that is joined to the bottom surface 24 of the hull and depends therefrom. This inboard side panel 58 is joined at its lower edge 60 to a second elongated bottom panel 62 that is oriented substantially horizontal and which defines the running surface of the starboard sponson. An elongated outboard side panel 64 is joined at its bottom edge 66 to the outboard edge 68 of the bottom panel 62. This outboard side panel 64 extends upwardly to define the starboard side of the hull. In like manner as the port sponson, the starboard sponson is pointed at its forward end 70 and increases in cross-sectional area to the approximate transverse midplane of the hull. The aft end portion 71 of the starboard sponson is of substantially constant cross-sectional area. Again, like the port sponson, the starboard sponson terminates at a location forwardly of the aft end of the hull, but rearwardly of the transverse midplane of the hull, and is closed by first and second upright panels 72 and 74, the first of which 72 slants inwardly of the hull and rearwardly of the outboard side 64 of the starboard sponson to form an angle of about 135° with the outboard side to reduce eddy currents as noted hereinabove. The second end panel 74 of the end closure is integrally formed with the first panel 72 and is oriented generally perpendicular to the longitudinal centerline of the hull. A generally triangular gusset 76 is provided as a continuation of the inboard side panel 58 of the starboard sponson, such gusset functioning in like manner as the gusset 54 associated with the port sponson and discussed hereinabove.

A third elongated sponson means 78, referred to herein as a center sponson, depends from the bottom surface 24 of the hull at a location between the port and starboard sponsons and in alignment with the longitudinal centerline of the hull. This center sponson comprises a first side panel 80 having its top edge 82 joined to the bottom surface 24 of the hull and depending therefrom. The second side panel 84, joined at its upper edge 86 to the bottom surface of the hull and depending therefrom defines the opposite side of the central sponson. The bottom edges 88 and 90 of the starboard and port side panels of the center sponson are joined by a bottom 92 comprising first and second elongated panels 94 and 96 that are joined at their respective outboard edges to the bottom edges 88 and 90, respectively, of the port and starboard panels 80 and 84 and which are oriented in a plane that is substantially perpendicular to the vertical longitudinal midplane of the hull. The bottom 92 further includes third and fourth elongated panels 106 and 108 that are joined at their respective outboard edges to the inboard edges of the first and second panels 94 and 96. Each of the third and fourth panels 106 and 108 is oriented at a downward angle with respect to the plane of the first and second panels 94 and 96 and inwardly of the hull. The bottom 92 of the center sponson is provided with a running pad that substantially defines the running surface of the center sponson and comprises first and second elongated panels 114 and 116 that depend from the inboard edges of the third and fourth panels 106 and 108 of the center sponson and whose bottom edges are joined by a generally horizontal panel 128 that is provided with a keel line 129 along a major portion of the length thereof. The center sponson extends from a location adjacent the bow of the hull to the aft end of the hull adjacent the transom. The running pad thereof extends from a location forwardly of the transverse midplane of the hull rearwardly to the aft end of the center sponson. The depicted pad is thin relative to its width. Its cross-sectional area increases from zero at its forward end to its maximum cross-sectional area at the aft end of the hull. As will be referred to hereinafter, the side panels 80 and 84 of the center sponson as well as the third and fourth panels 106 and 108 and the panels 114 and 116 of the running pad assist in turning movements of the boat.

Figure 6:
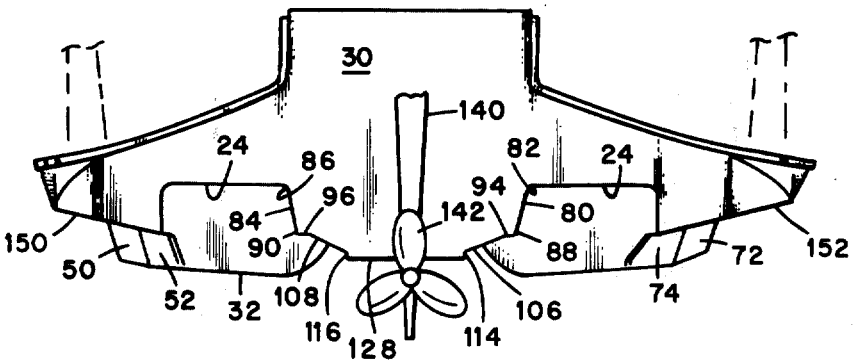
FIG. 6 is a perspective type representation of the aft end of the boat hull.
Figure 7:
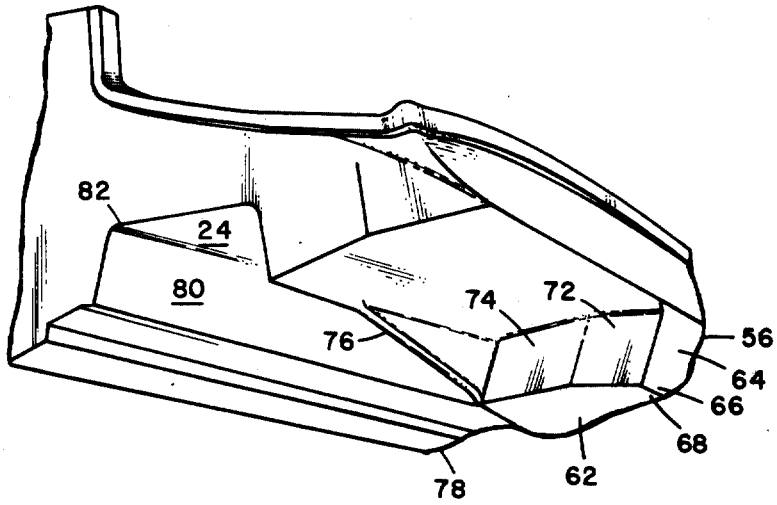
FIG. 7 is a fragmentary view of the starboard side of the aft end of the boat hull.
Figure 10:
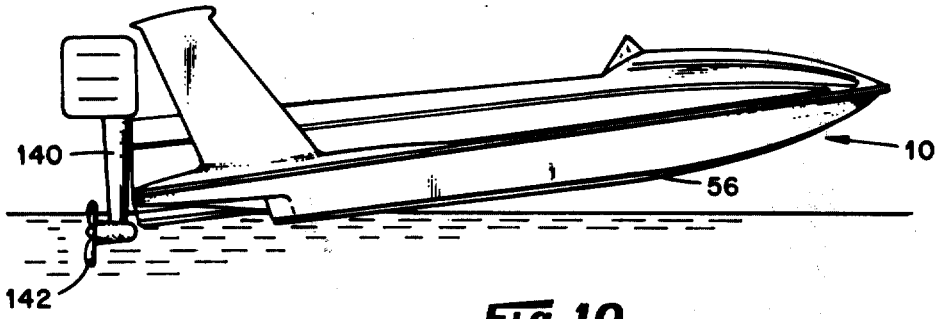
FIG. 10 is a representation of a boat having a hull embodying various features of the invention as supported on a body of water.

As best seen in FIGS. 6 and 10, a conventional outboard motor (showns fragmentarily) is mounted on the transom 30 for powering the boat. The foot 140 of the motor extends downwardly alongside the aft side of the transom to position the drive propeller 142 in the water for propelling the boat. As seen in FIG. 6, the center sponson leads the foot 140 as the boat moves forwardly through the water and opens a path through the water thereby reducing the drag on the foot, hence reducing the drag on the boat. Commonly with the tunnel boats heretofore known in the prior art, the drag of a motor foot in the water substantially slows down the boat. In a preferred arrangement, the propeller is disposed at a vertical height which positions the propeller just beneath the surface of the water when the boat is at rest in the water. Thus, as the boat gains momentum and the lift forces acting thereupon take effect, the propeller is moved nearer the surface of the water and, in fact, a portion of the propeller is disposed out of the water. In this manner, the resistance on the propeller is minimized while maintaining adequate contact with the water and the motor is allowed to attain maximum revolutions per minute, hence maximum rotational speed of the propeller and maximum acceleration of the boat, at an early stage in the commencement of forward movement of the boat. This capability of adjusting the position of the propeller within the water is accomplished by the lift features afforded in the present hull and by reason of the center sponson opening a path through the water along which the propeller and motor foot move.

It will be recognized that when a boat having a hull of the type disclosed herein is at rest in the water, there will be water disposed within the port and starboard tunnels and a substantial portion of the port and starboard and center sponsons will be disposed beneath the surface of the water. As the motor speed is increased to rotate the propeller faster, the boat commences its forward movement over the surface of the water. Thereupon air moves into the forward ends of the tunnels and is compressed in the direction toward the aft end of the tunnels. In addition, the upwardly curved running surfaces of the port and starboard sponsons, and of the center sponson and its running pad provide lift to the boat causing the bow thereof to rise off the surface of the water. As the speed of forward movement of the boat increases, greater lift is generated both by the compressed air within the tunnels and the lift afforded by the several sponsons, thereby eventually lifting the boat substantially out of the water so that, at planing speeds, only the aft terminal ends of the port and starboard sponsons and the aft end of the center sponson are in contact with the water. Under these conditions, air flows into the forward ends of the port and starboard tunnels and out the aft ends thereof, the air being compressed between the bottom surface of the boat, the tunnel sides and the surface of the water as the air moves through the tunnels. To prevent premature escape of the compressed air from the aft ends of the tunnels, the gussets 54 and 76 at the terminal ends of the port and starboard sponsons function to prevent lateral flow of air from each of the port and starboard tunnels. In this manner, the lift effect afforded by the compressed air within the tunnels is maintained until the air exits the aft ends of the tunnels, thereby maintaining the lift function of the compressed air to a location adjacent the aft end of the hull. If desired, this air lift action can be continued past the transom by extending the tunnels therepast. Such extensions of the tunnels preferably are not of a length that causes them to interfere with the motor foot or propeller. Thus, the aft portion of the hull is prevented from sinking too deeply into the water and introducing substantial frictional drag against forward movement of the boat. As noted hereinbefore, the ends of the port and starboard sponsons have tapered panels 52 and 72 on the outboard sides that form angles with the respective outboard sides of the sponsons to reduce the establishment of eddy currents adjacent the aft terminal ends of the port and starboard sponsons, thereby reducing the frictional drag exerted against the hull by such eddy currents.

Figure 4:
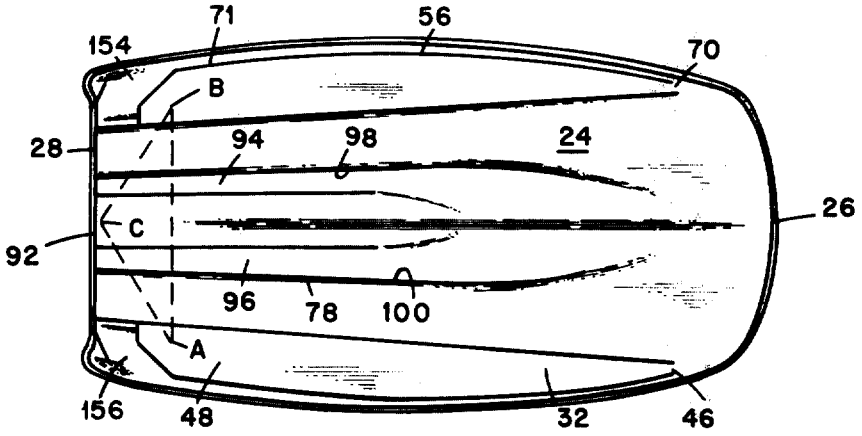
FIG. 4 is a bottom view of the boat hull showing on approximate placement of the outboard sponsons and their planing speed water contact points.
Figure 5:
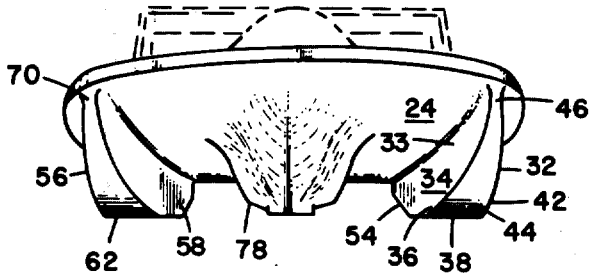
FIG. 5 is a representation of the bow end of the boat hull.

As noted, when the boat is at planing speed, as depicted in FIG. 10, the hull is supported on the surface of the water at three locations, namely, adjacent the aft end of the port sponson (see A in FIG. 4), the aft end of the starboard sponson (B in FIG. 4), and the aft end of the center sponson (C in FIG. 4). Importantly, the support locations at the aft ends of the port and starboard sponsons are located forwardly of the aft end of the hull and are disposed substantially outboard of the centerline of the hull. By this means, the hull is stabilized against rotational movement about its longitudinal centerline. The location of the third point of support is adjacent the aft end of the center sponson where the center sponson provides lift to the hull, both to keep the hull adjacent the surface of the water and to counteract wind forces acting to lift the bow of the hull. In this manner, the boat is stabilized against rotation about its transverse centerline, hence is stabilized against flipping of the boat backwardly.

In a preferred embodiment, the vertical height of the plane within which the running pad of the center sponson resides is above the vertical height of the plane of the running surfaces of the port and starboard sponsons. By reason of this construction feature, as the boat moves along the surface of a body of water, the boat is initially lifted out of the water by lift forces exerted by the bottom of the boat, the center sponson, and the port and starboard sponsons, i.e. water lift. As the boat gains momentum, the lift to the boat contributed by the compressed air and/or water within the tunnels, i.e. air lift, predominates over the lift provided by the sponsons. It is to be understood, however, that the aft end of the center sponson is in contact with the water at substantially all times and at such times contributes substantial lift to the boat. The center sponson, with its aft end in contact with the water, is thus readily available for immediate application of relatively great lift forces to the aft end of the boat, should the bow of the boat be raised substantially upward from its plane during normal running speeds of the boat.

As noted above, when a boat provided with the present hull is moving through the water, the center sponson cuts a path through the water. At the higher speeds, such as planing speed, the air lift and water lift are such that the hull is out of the water to the extent that the water displaced laterally by the center sponson flows or moves under the port and starboard sponsons over a major portion of their respective lengths, depending upon the speed of the boat. Thus, at the highest speeds, the port and starboard sponsons are in minimal contact with the water to reduce drag but are in sufficient contact to stabilize the boat laterally. At such high speeds, the aft ends of the port and starboard sponson appear to "tip toe" over the surface of the water. For these reasons, the boat is extremely stable in the water at the higher speeds due to the lateral placement of the locations of the lift with respect to the centerline of the boat. Further, by these means, the present hull is exceptionally stable within the water, both as concerns rotation about its longitudinal centerline and its transverse centerline, all with minimal frictional drag between the hull and the water. Still further, because of this exceptional stability of the boat at its running speeds, the boat is less sensitive to steering errors, to the point that an amateur boat operator can reasonably safely operate a boat employing the disclosed hull without an extensive training period. As noted hereinbefore, the stability of the boat against rotation about its transverse centerline stabilizes the boat against backward flipping such as has been a common tendency in the tunnel boats of the prior art. Still further, the laterally displaced points of support at the port and starboard sponsons eliminate the problems found in V-bottom boats of the boat "falling off" of the triangular area of contact between the V-bottom boat and the water.

The lift provided by the center sponson has also been found to provide better weight-carrying ability to the hull in that a boat provided with the present hull will run faster than known prior art boats carrying a like load and using an equal motor.

The maneuverability of a boat provided with the disclosed hull has been found to be enhanced by terminating the port starboard sponsons at a location forward of the aft end of the hull, in that the absence of the sponsons adjacent the aft end of the hull reduces resistance to lateral movement of the aft end, leaving the aft end relatively free to move laterally when changing the boat's forward direction. In the course of such turns, the aft end of the center sponson acts in the nature of a keel to prevent overreaction of the boat in a turn.

In a preferred embodiment, each of the port and starboard sponsons terminates at its aft end at a location disposed forwardly of the aft end of the hull a distance of approximately one-third of the distance between the transverse midplane and the aft end of the hull. This construction leaves the aft end of the hull relatively free in a turn as referred to above. Further by terminating the port and starboard sponsons at a location forwardly of the aft end of the hull, there is eliminated substantial drag on the hull, such as would occur if there were substantial portions of the aft ends of the port and starboard sponsons in contact with the water. Whereas each of the port and starboard sponsons terminates as stated, the body portion of the hull continues rearwardly of the terminal end of each sponson to the transom to define an "after sponson" 150 and 152, respectively, that includes a planar bottom 154 and 156, respectively. These "after sponsons" ride in the water when the boat is at rest or only moving slowly to provide buoyancy to the aft end of the boat. They further serve to exert lift to the aft end as the boat is accelerated to the point that these after-sponsons rise off the surface of the water, as when the boat achieves its planing speed.

In one embodiment, each of the tunnels is provided with a slight concavity in the bottom surface of the hull that defines the top side of the respective cavity. This concavity has been found to provide better air compression, hence enhance the lift effectiveness of the tunnels. Additionally, such construction enhances the strength of the hull, thereby permitting the use of less construction material and a resultant lighter hull of equal durability and strength.

At substantial running speeds, the hull is buoyed by a cushion of air in each of the tunnels. The present hull therefore provides a softer ride, particularly when in choppy waters because of such air cushion and further because of the minimal portion of the hull that is in the water. These and other factors, as noted, contribute to the better acceleration, better fuel economy (due in large part to reduced drag), and higher speeds attainable in boats provided with the disclosed hull.

Whereas there has been described a specific embodiment of the disclosed hull, it is to be recognized that one skilled in the art could make modifications and/or changes and the scope of the invention is intended to be limited only as set forth in the claims.

What is claimed is:

1. A boat hull comprising a generally elongated body portion including bow means and transom means, first and second elongated sponson means depending from said body portion along the opposite side margins of said body portion and defining elongated running surfaces, said first and second sponson means terminating at their respective aft ends at a location forward of said transom means, but rearwardly of the transverse midplane of said hull, third elongated sponson means depending from said body portion at a location centrally thereof in substantial alignment with the longitudinal centerline of said body portion and defining an elongated running surface that extends beyond the aft terminal ends of said first and second sponson means to the approximate location of said transom means, said first and third sponson means in combination with said body portion defining a first elongated tunnel means extending along a substantial portion of the length of said body portion in general alignment with said longitudinal centerline of said body portion but displaced laterally thereof, said second and third sponson means in combination with said body portion defining a further elongated tunnel means extending along a substantial portion of the length of said body portion in general alignment with said longitudinal centerline of said body portion but displaced laterally thereof and on the opposite side of said longitudinal centerline as said first tunnel means, each of said first and further tunnel means being open at its respective forward and aft ends for the flow of fluid therealong and reducing in cross-sectional area from the forward end of said hull toward the aft end of said hull.

2. The boat hull of claim 1 wherein each of said port and starboard sponson means terminates at its aft end at a location disposed forwardly of the aft end of said hull a distance of approximately one-third of the distance between the transverse midplane and the aft end of said hull.

3. The boat hull of claim 1 wherein the aft terminal end of each of said port and starboard sponsons is closed by first and second end panels, one of said panels being outboard relative to the other of said panels, the outboard one of which is oriented angularly inwardly toward the longitudinal centerline of said hull.

4. The boat hull of claim 1 wherein said third sponson means includes a running pad that extends from a location forwardly of the transverse midplane of said hull to the aft end of said hull.

5. The boat hull of claim 1 wherein that elongated part of each of said body portions which combines with individual sponson means to define a respective tunnel means is rounded to define an elongated concavity at the top portion of said tunnel means said concavity extending along a substantial portion of the length of its respective tunnel means and having its focal line aligned with the longitudinal dimension of said tunnel means.

* * * * *